US009849480B2

(12) United States Patent
Lessley et al.

(10) Patent No.: US 9,849,480 B2
(45) Date of Patent: Dec. 26, 2017

(54) LAMINATED NOZZLE WITH THICK PLATE

(71) Applicant: Illinois Tool Works Inc., Glenview, IL (US)

(72) Inventors: Mel Steven Lessley, Villa Hills, KY (US); Edward W. Bolyard, Jr., Old Hickory, TN (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 15/253,198

(22) Filed: Aug. 31, 2016

(65) Prior Publication Data

US 2017/0014853 A1 Jan. 19, 2017

Related U.S. Application Data

(63) Continuation-in-part of application No. 14/881,369, filed on Oct. 13, 2015, now Pat. No. 9,561,654.

(Continued)

(51) Int. Cl.

| | |
|---|---|
| ***B05C 5/02*** | (2006.01) |
| ***B05B 7/02*** | (2006.01) |
| ***B05B 7/08*** | (2006.01) |
| ***B05C 9/06*** | (2006.01) |
| ***B05C 11/10*** | (2006.01) |

(Continued)

(52) U.S. Cl.

CPC ..... *B05C 5/027* (2013.01); *B05B 7/025* (2013.01); *B05B 7/08* (2013.01); *B05B 7/0807* (2013.01); *B05B 7/0876* (2013.01); *B05B 7/0884* (2013.01); *B05C 5/0254* (2013.01); *B05C 9/06* (2013.01); *B05C 11/1036* (2013.01);

(Continued)

(58) Field of Classification Search

CPC .... B41J 2/1433; B05B 7/0807; B05B 7/0874; B05B 7/0884; B05B 7/0408; B05B 7/12; B05C 5/027; B05C 5/0254; B05C 9/06; B05C 11/1036

USPC ..... 347/29

See application file for complete search history.

(56) References Cited

U.S. PATENT DOCUMENTS 4,680,595 A 7/1987 Cruz-Uribe et al.
5,157,420 A * 10/1992 Naka ..... B41J 2/14233 347/40

(Continued)

OTHER PUBLICATIONS

International Search Report issued by ISA/EPO in connection with PCT/U52015/059438 on Feb. 18, 2016.

(Continued)

*Primary Examiner* — Huan Tran
*Assistant Examiner* — Alexander D Shenderov
(74) *Attorney, Agent, or Firm* — Levenfeld Pearlstein, LLC

(57) ABSTRACT

A laminated nozzle assembly includes a first end plate having first and second fluid inlets, a second end plate, and a plurality of nozzle plates positioned between the first and second end plates. A first fluid conduit is fluidically connected to the first fluid inlet. The first fluid conduit has a reservoir and one or more first openings. A second fluid conduit is fluidically connected to the second fluid inlet. The second fluid conduit has an inlet channel, a connecting channel and one or more second openings. An orifice assembly includes a first orifice fluidically connected to the first opening and a second orifice fluidically connected to the second opening. The first and second orifices are disposed in the same plate of the plurality of nozzle plates and are coplanar.

20 Claims, 9 Drawing Sheets

Related U.S. Application Data

(60) Provisional application No. 62/084,897, filed on Nov. 26, 2014.

(51) Int. Cl.
*B41J 2/14* (2006.01)
*B05B 7/04* (2006.01)
*B05B 7/12* (2006.01)

(52) U.S. Cl.
CPC ..... *B41J 2/1433* (2013.01); *B05B 7/0408* (2013.01); *B05B 7/12* (2013.01)

(56) References Cited

U.S. PATENT DOCUMENTS

| | | | | |
|---|---|---|---|---|
| 5,882,573 | A | 3/1999 | Kwok et al. | |
| 5,902,540 | A | 5/1999 | Kwok | |
| 5,904,298 | A | 5/1999 | Kwok et al. | |
| 6,074,597 | A | 6/2000 | Kwok et al. | |
| 6,197,406 | B1 | 3/2001 | Kwok | |
| 6,200,635 | B1 | 3/2001 | Kwok | |
| 6,375,099 | B1 | 4/2002 | McGuffey | |
| 6,461,430 | B1 | 10/2002 | Kwok | |
| 6,540,831 | B1 | 4/2003 | Craine et al. | |
| 6,890,167 | B1 | 5/2005 | Kwok et al. | |
| 6,955,420 | B2 * | 10/2005 | Ito | B41J 2/14209 347/71 |
| 8,985,485 | B2 | 3/2015 | Budai et al. | |
| 2004/0113992 | A1 | 6/2004 | Drury et al. | |
| 2004/0174412 | A1 * | 9/2004 | Ohashi | B41J 2/17526 347/50 |
| 2007/0125877 | A1 | 6/2007 | Zillig et al. | |
| 2012/0121803 | A1 | 5/2012 | Pahl et al. | |
| 2013/0192520 | A1 | 8/2013 | Burmester et al. | |
| 2013/0215197 | A1 * | 8/2013 | Hays | B41J 2/161 347/40 |
| 2015/0202648 | A1 | 7/2015 | Bolyard, Jr. | |

OTHER PUBLICATIONS

International Preliminary Report on Patentability issued by ISA/EPO in connection with PCT/US2015/059438 on May 30, 2017.

* cited by examiner

LAMINATED NOZZLE WITH THICK PLATE

CROSS-REFERENCE TO RELATED APPLICATION DATA

This application is a continuation-in-part of U.S. patent application Ser. No. 14/881,369, filed Oct. 13, 2015, which claims the benefit of provisional U.S. Patent Application Ser. No. 62/084,897, filed Nov. 26, 2014, the disclosures of which are incorporated herein in their entirety.

BACKGROUND

The following description relates to a laminated nozzle assembly having one or more thick plates.

A laminated nozzle assembly may be used to discharge a hot melt adhesive onto a substrate. The substrate may be, for example, a layer of material, such as a nonwoven fabric, or a strand of material, such as an elastic strand to be applied on an article. The article may be, for example, a disposable hygiene product. The laminated nozzle assembly may include one or more first discharge slots for discharging the hot melt adhesive and one or more second discharge slots configured to discharge air. The discharged air causes the discharged hot melt adhesive to oscillate or vacillate during application to the substrate.

FIG. 1 shows a partial exploded view of a conventional laminated nozzle assembly 10. Referring to FIG. 1, a conventional laminated nozzle assembly 10 includes a plurality of plates having internal conduits formed therein allowing flow of the hot melt adhesive and air therethrough. FIG. 2 is a plan view of the individual plates forming the conventional laminated nozzle assembly 10. Referring to FIGS. 1 and 2, the conventional laminated nozzle assembly may include eleven plates 12, 14, 16, 18, 20, 22, 24, 26, 28, 30, 32 secured between a first end plate 34 and a second end plate 36. A first internal conduit 38 may be formed through a plurality of the plates for delivering the hot melt adhesive to a first discharge slot 40. The first internal conduit 38 is formed by a plurality of aligned openings in the plates. A second internal conduit 42 may also be formed through a plurality of the plates for delivering the air to a second discharge slot 44. The second internal conduit 42 is formed by a plurality of aligned openings in the plates.

FIG. 9*a* is an enlarged plan view of plates 20, 22, 24 of the conventional laminated nozzle assembly 10 of FIGS. 1 and 2. Referring to FIGS. 2 and 9*a*, plate 20 includes a plurality of first apertures 46. The first apertures 46 are disposed in the first internal conduit 38 and split the first internal conduit 38 into multiple flow paths for the first fluid. Similarly, plate 24 includes a plurality of second apertures 48. The second apertures 48 are disposed in the second internal conduit 42 and split the second internal conduit 42 into multiple flow paths for the second fluid. The first and second apertures 46, 48 are circular in shape, as shown in the plan view. Each first aperture 46 has an area of approximately 0.00031 $in^2$, and each second aperture 48 also has an area of approximately 0.00031 $in^2$.

With further reference to FIGS. 1, 2 and 9*a*, the nozzle plate 22 of the conventional nozzle assembly 10 includes a plurality of discharge assemblies 50. Each discharge assembly 50 includes a first discharge slot 40 and a pair of second discharge slots 44. The first discharge slot 40 and second discharge slots 44 each include an inlet end 52, 54 having a size and shape corresponding to the size and shape of the first and second apertures 46, 48. That is, the inlet end 52 of the first discharge slot 40 is circular in shape and is configured to receive the first fluid from the first aperture 46, and the inlet ends 54 of the second discharge slots 44 are circular in shape and configured to receive the second fluid from the second apertures 48. The inlet ends 52, 54 of the first and second discharge slots 40, 44 have a greater diameter or width than an adjacent intermediate portion 56, 58 of the respective first and second discharge slots 40, 44 to which the fluid flows.

The flow paths defined by the first and second internal conduits 38, 42 may be indirect, circuitous, or otherwise inhibit efficient flow of the fluids (i.e., the hot melt adhesive and/or the air) through the laminated nozzle assembly 10. For example, the flow path defined by the first internal conduit includes a number of stepwise changes in direction, extends laterally to locations near outer edges of the laminated plates and extends at these locations through numerous plates. In addition, the first and second apertures 46, 48 of the first and second internal conduits 38, 42 are small and restrict flow of the first and second fluids. In addition, the narrowing of the width or diameter between the inlet ends 52, 54 and respective intermediate portions 56, 58 of the first and second discharge slots 40, 44 may also restrict fluid flow.

Restricted fluid flow in the convention nozzle assembly 10 may cause a decrease in a velocity of the fluid in the nozzle assembly 10. In particular, the indirect, circuitous, or otherwise flow inhibiting characteristics of the flow path for the hot melt adhesive may cause a decrease in velocity and allow the hot melt adhesive to collect in various portions of the first internal conduit 38. The reduced velocity and collection of the hot melt adhesive may lead to plugging of the first conduit 38.

In addition, reduced velocity and/or fluid collection of the hot melt adhesive in the first internal conduit 38 may lead to cooling of the hot melt adhesive. In particular, with a reduced velocity, the hot melt adhesive requires a longer length of time to flow through the nozzle assembly 10. The hot melt adhesive is fed to the nozzle assembly at a desired temperature. However, upon flowing into the nozzle assembly 10, the hot melt adhesive may cool with time. Cooling of the hot melt adhesive may lead to increased viscosity, which may also inhibit flow through nozzle assembly 10 by reducing velocity and/or collecting in various portions of the first internal conduit 38.

Cooling of the fluids, and in particular, the hot melt adhesive, may also occur as result of prolonged exposure to a conduit wall near an edge region of the nozzle assembly 10. That is, in the conventional nozzle assembly 10, the first internal conduit may extend in a width direction to an area relatively close to an edge region of the plates. As such, ambient air, typically at a lower temperature than the hot melt adhesive, may cool the hot melt adhesive through the relatively thin edge region of the plates. Prolonged exposure to this lower-temperature edge region may result from a length of the flow path in this region, or a lower velocity of fluid in this region.

Moreover, when the chemistry and manufacturing of the discharged material (e.g., the adhesive) is not well controlled, particulate matter or contaminants, ash and/or other residue may be present in the material when introduced to the nozzle assembly 10, and charring may occur at what are otherwise normal operating temperatures. The existence of such particulate matter, contaminants, or the like may further exaggerate plugging of the conduits, for example, at the apertures 46, 48, discharge slots 40, 44 or other areas where flow is restricted and/or fluid velocity is reduced.

To this end, filter plates 16, 28 are included in the conventional laminated nozzle assembly 10. The filter plates 16, 28 include a plurality of filter openings 60, 62 and are disposed in respective flow paths defined by the first internal conduit 38 and second internal conduit 42. Accordingly, the filter plates 16, 28, and in particular, the filter openings 60, 62 may collect any particular matter, contaminants or other residue exceeding a predetermined size that is present in the fluids.

However, the filter plates 16, 28, disposed in respective first and second internal conduits 38, 42, even when clean, restrict flow of the fluids. As a result, the fluids, and in particular, the hot melt adhesive, may collect upstream from the filter plate 16 in the first internal conduit 38 and experience a decrease in velocity. These drawbacks are magnified as the filter plates 16, 28 collect the particulate matter, contaminants, or the like, from the fluids, since an area of the filter plates 16, 28 through which the fluid may flow is reduced.

In addition, with the indirect flow paths in the conventional laminated nozzle assembly 10, a dwell time, or time of the fluid to travel from an inlet of the laminated nozzle assembly 10 to discharge slots 40, 44 may be undesirably long. This may affect start/stop performance of the laminated nozzle assembly 10 by discharging fluid for an undesirable amount of time after shut off, or delaying discharge of fluid for an undesirable amount of time after starting the application device. In turn, an application pattern of the fluid, and in particular, start and stop locations, onto the substrate may not be precisely controlled.

Accordingly, it is desirable to provide a laminated nozzle assembly having an internal conduit or conduits allowing for increased passageway size, higher fluid velocity, and more direct flow paths to the discharge orifices.

SUMMARY

According to one aspect, a laminated nozzle assembly includes a first end plate having a first fluid inlet and a second fluid inlet, a second end plate, and a plurality of nozzle plates positioned and clamped between the first end plate and the second end plate. The laminated nozzle assembly also includes a first fluid conduit in fluid communication with the first fluid inlet formed in one or more of the nozzle plates, the first fluid conduit having a reservoir and one or more first openings positioned in fluid communication with the reservoir, and a second fluid conduit in fluid communication with the second fluid inlet formed in one or more of the nozzle plates, the second fluid conduit having an inlet channel, a connecting channel positioned in fluid communication with the inlet channel, and one or more second openings positioned in fluid communication with the connecting channel. The laminated nozzle assembly further includes an orifice assembly having a first orifice in fluid communication with a corresponding one of the first openings to receive the first fluid from the first opening, and a second orifice in fluid communication with a corresponding one of the second openings formed to receive the second fluid from the second opening. The first orifice and second orifice are disposed in the same plate of the plurality of nozzle plates and are coplanar.

In an embodiment, the first and second orifices are coplanar with one another. In an embodiment the laminated nozzle assembly includes less than eight (8) nozzle plates. In an embodiment, the laminated nozzle assembly included five (5) nozzle plates. The nozzle plates can include a plurality of first and second orifices. In an embodiment, at least some of the nozzle plates have a thickness of, for example, about 0.005 to about 1.00 mm and more specifically, may have a range of thickness between about 0.125 to 0.50 mm.

In an embodiment, the laminated nozzle assembly minimizes the number of nozzle plates and includes no more than eight, and preferably no more than five nozzle plates.

These and other features and advantages of the present invention will be apparent from the following detailed description, in conjunction with the appended claims.

DETAILED DESCRIPTION

While the present device is susceptible of embodiment in various forms, there is shown in the figures and will hereinafter be described a presently preferred embodiment with the understanding that the present disclosure is to be considered an exemplification of the device and is not intended to be limited to the specific embodiment illustrated.

Figure 1:
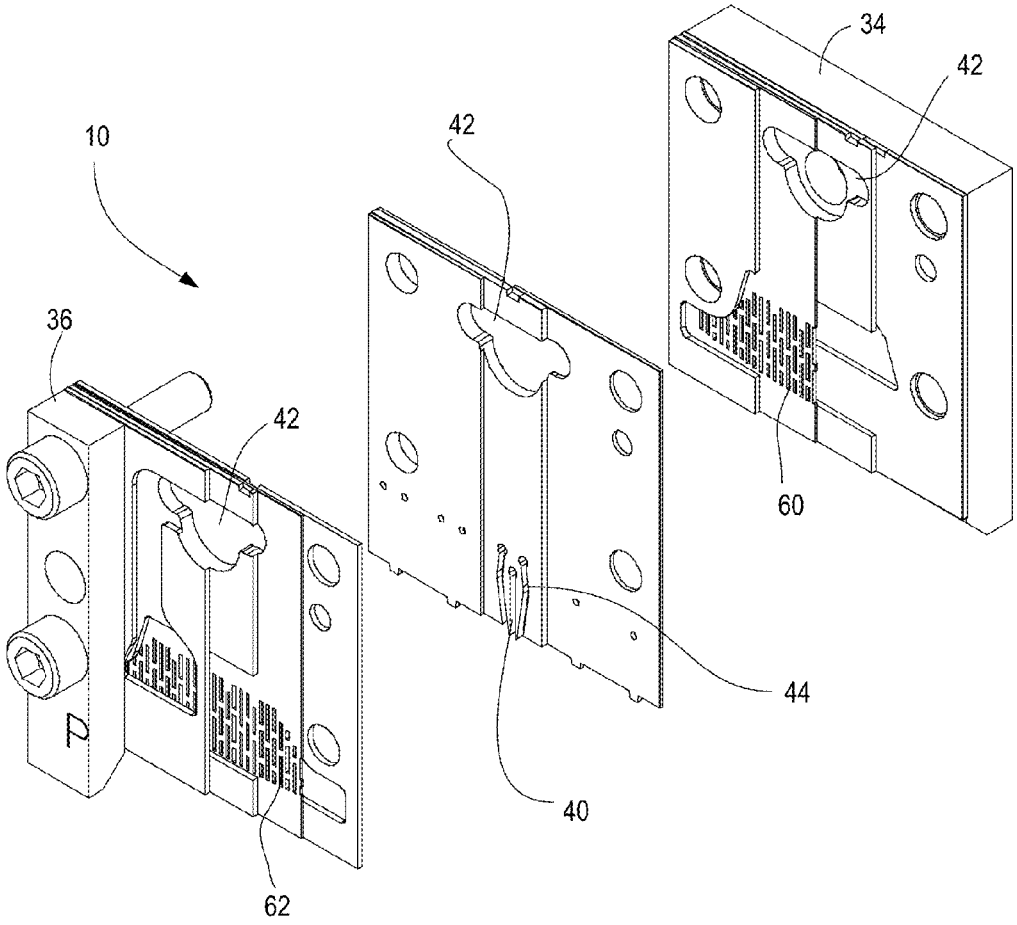
Fig. 1 Prior Art
FIG. 1 is a partial exploded view of a conventional laminated nozzle assembly.
Figure 2:
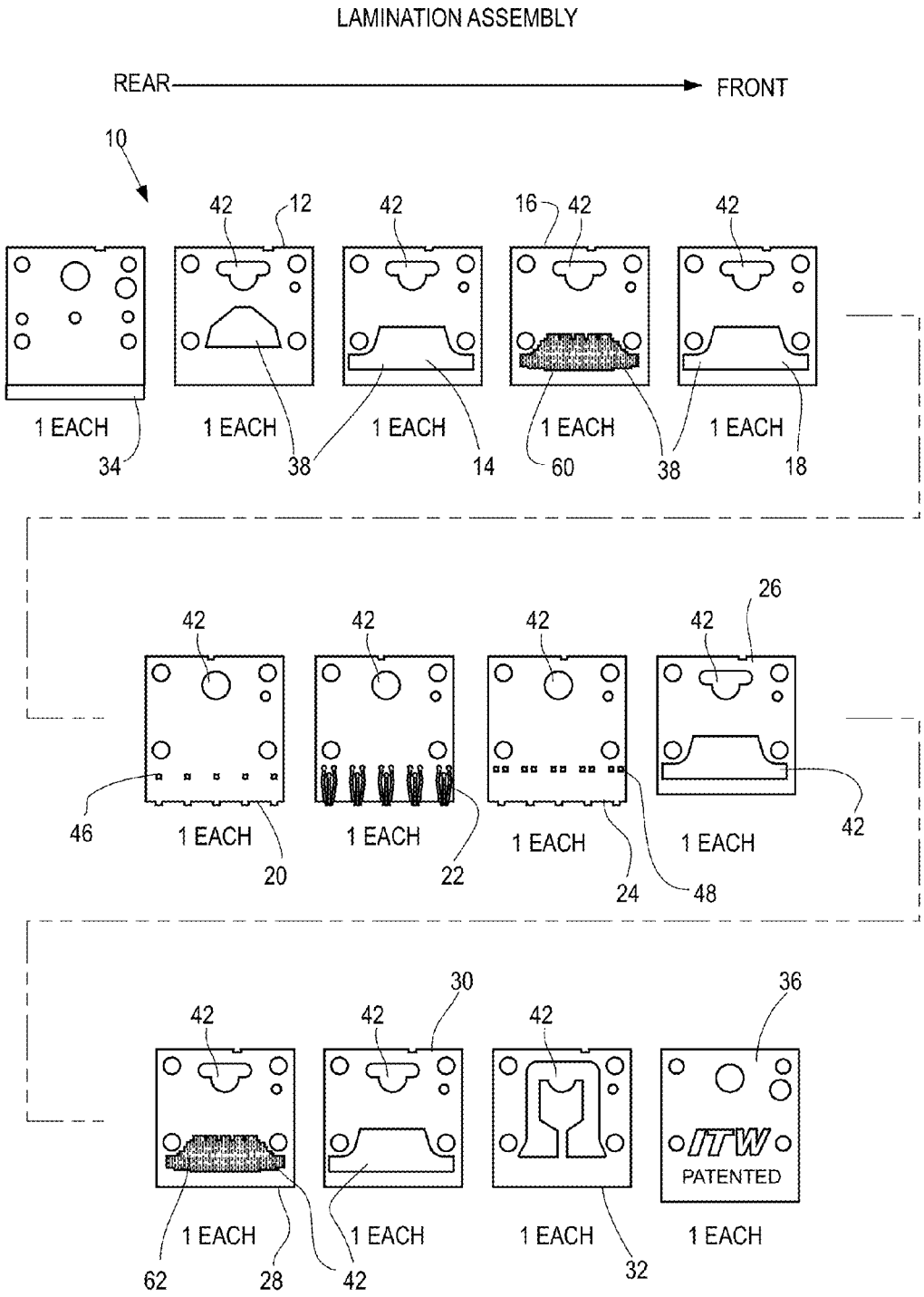
Fig. 2 Prior Art
FIG. 2 is a plan view of the individual plates forming the conventional laminated nozzle assembly of FIG. 1.
Figure 3:
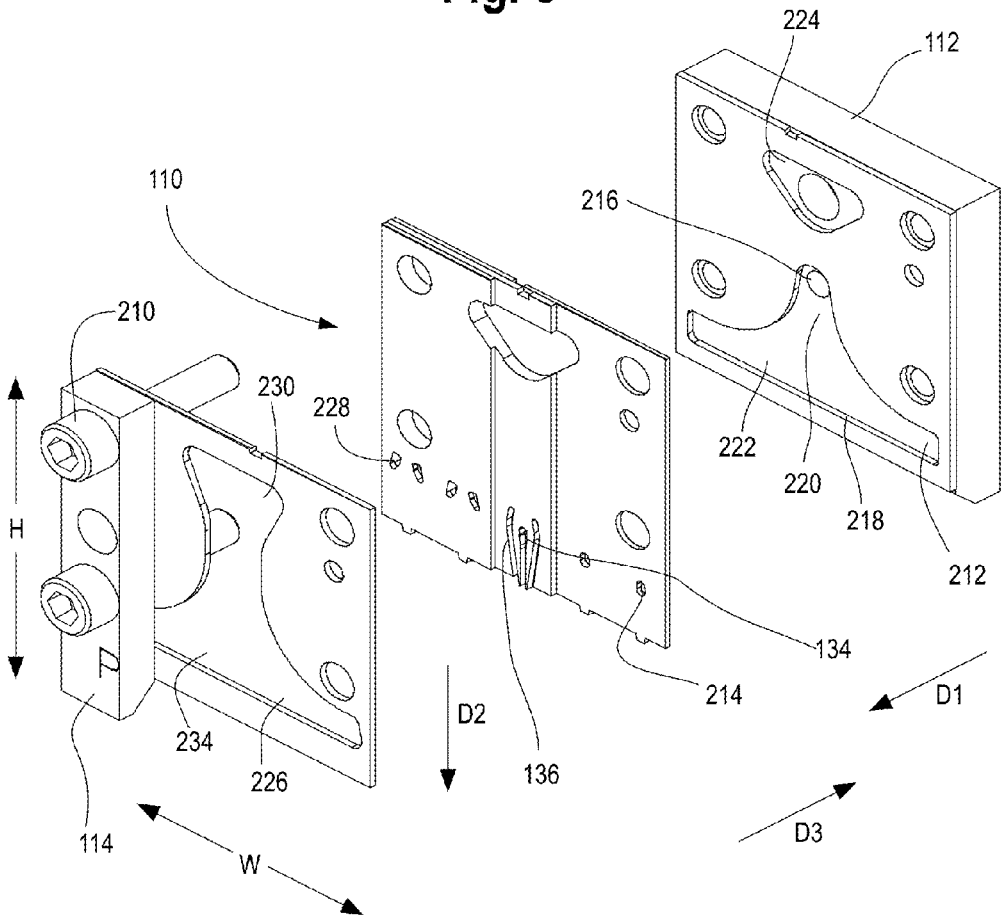
FIG. 3 is a partial exploded view of a laminated nozzle assembly according to an embodiment described herein.
Figure 4:
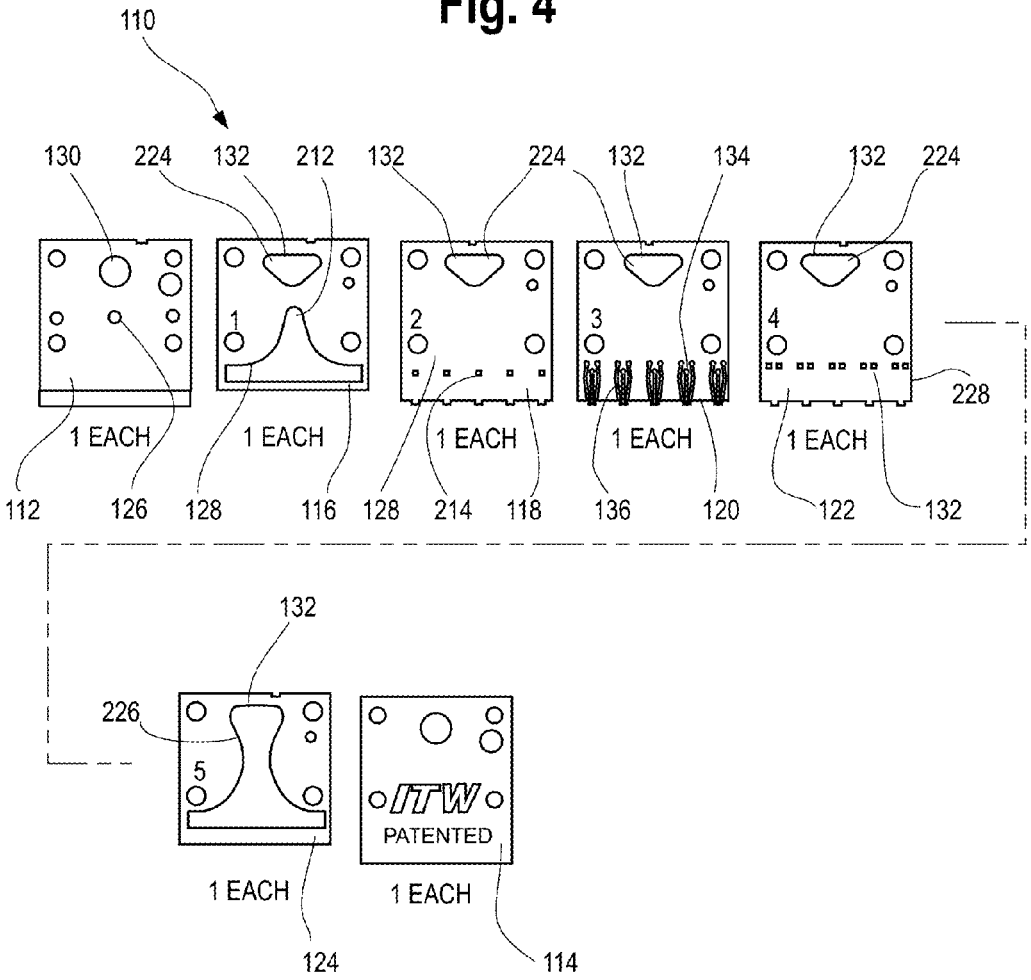
FIG. 4 is a plan view of individual plates forming the laminated nozzle assembly of FIG. 3.

FIG. 3 is a partial exploded view of a laminated nozzle assembly 110 according to one embodiment described herein. FIG. 4 is a plan view of individual plates forming the laminated nozzle assembly of FIG. 3. The laminated nozzle assembly 110 may be formed, for example, with six or fewer nozzle plates positioned between first and second end plates. Referring to FIGS. 3 and 4, in one embodiment, the laminated nozzle assembly 110 may include a first end plate 112, a second end plate 114, and five nozzle plates 116, 118, 120, 122, 124 positioned between the first end plate 112 and the second end plate 114. As shown in FIGS. 3 and 4, first and second end plates 112, 114 and the nozzle plates 116, 118, 120, 122, 124 may be secured together with the nozzle plates clamped between the end plates 112, 114, by one or more fasteners 210.

Referring to FIG. 4, a first fluid inlet 126 may be formed in the first end plate 112. A first fluid conduit 128 may be formed in one or more of the first end plate 112 and/or one or more of the nozzle plates 116, 118, 120, 122, 124. In one embodiment, the first fluid conduit 128 is formed in nozzle plates 116, 118. The first fluid conduit 128 may be formed by aligned or partially aligned openings in nozzle plates 116, 118, wherein the opening or openings of the first fluid conduit 128 in one plate are in fluid communication with the opening or openings of the first fluid conduit 128 in an immediately adjacent plate. The first fluid conduit 128 is in fluid communication with the first fluid inlet 126 and is configured to receive the first fluid therefrom. The first fluid may be, for example, a hot melt adhesive, a cold melt adhesive or other fluid ranging from 0 centipoise to 100,000 centipoise. It is understood that the aligned or partially aligned openings forming the first fluid conduit 128 may be of different shape or size than one another so long as the opening or openings in respective plates are in fluid communication with the opening or openings in an immediately adjacent abutting plate.

In one embodiment, the first fluid conduit 128 may include a reservoir 212 and one or more first openings 214 fluidically connected to the reservoir 212 and configured to receive the first fluid from the reservoir 212. For example, referring still to FIG. 4, the reservoir 212 may be formed in nozzle plate 116. Although the reservoir 212 is shown as being formed in a single plate only, it is understood that the reservoir 212, in some embodiments, may be formed in more than one nozzle plate.

Referring to FIGS. 3 and 4, in one embodiment, the reservoir 212 has a peak 216 and a base 218. The reservoir 212 may increase in width moving from the peak 216 to the base 218, such that a width at the peak 216 is less than a width at the base 218. In addition, the reservoir 212 may be formed having a substantially triangular section 220, with the peak 216 corresponding to an apex of the triangle. The sides extending from the peak 216 may be inwardly curved, i.e., formed with a concavity. The reservoir 212 may further include a base section 222 connected to and formed continuously with the triangular section 220. The base section 222 may generally be formed as a section of constant width and having a height. Thus, the base section 222 may be formed substantially in the shape of a square or rectangle.

The one or more first openings 214 may be formed in a plate or plates adjacent to the plate or plates in which the reservoir 212 is formed. For example, in one embodiment, the one or more first openings 214 may be formed in a single plate 118. The plurality of first openings 214 splits the first fluid conduit 128 into a plurality of spaced apart flow paths, each opening 214 corresponding to a flow path. In one embodiment, the one or more first openings 214 are formed having the same, or substantially the same size and shape, and lie on a common center line.

The first end plate 112 may further include a second fluid inlet 130. The second fluid inlet 130 is in fluid communication with a second fluid conduit 132 formed in one or more nozzle plates 116, 118, 120, 122, 124. Alternatively, at least a portion of the second fluid conduit 132 may be formed in at least one of the first end plate 112 and/or second end plate 114. In one embodiment, as shown in FIG. 4, the second fluid conduit 132 is formed by openings in each of the plates 116, 118, 120, 122, 124. The second fluid conduit 132 is in fluid communication with the second fluid inlet 130 and is configured to receive the second fluid therefrom. In addition, the openings forming the second fluid conduit are aligned or partially aligned with one another and in fluid communication with one another. It is understood that the size and position of the openings forming the second fluid conduit may vary so long as the opening or openings formed in one plate remain in fluid communication with the opening or openings formed in an immediately adjacent abutting plate. The second fluid may be, for example, air.

In one embodiment, the second conduit 132 may include an inlet channel 224, a connecting channel 226 and a one or more second openings 228. The inlet channel 224, connecting channel 226 and one or more second openings 228 are fluidically connected to one another and arranged in series with one another such that the second fluid flows from the inlet channel 224, to the connecting channel 226, and then to the one or more second openings 228.

In one embodiment, the inlet channel 224 is formed in one or more of the nozzle plates 116, 118, 120, 122, 124 and is configured to receive the second fluid from the second inlet 130. As shown in FIG. 4, for example, the inlet channel 224 is formed in four plates 116, 118, 120, 122 by a series of aligned openings having the same, or substantially the same, size and shape. In one embodiment, each of the aligned openings forming the inlet channel 224 may be an inverted substantially triangular shape, with round corners. Other suitable shapes are envisioned as well, including, for example, circular, oval or a polygonal shape with or without rounded corners. With further reference to FIG. 4, the inlet channel 224 may be formed in a generally upper portion of the nozzle plates. Referring again to FIG. 3, the inlet channel 224 extends generally in a first direction D1 away from the first end plate 112 to allow the second fluid to flow in the first direction away from the second inlet 130.

The connecting channel 226 may be formed in one or more of the nozzle plates. For example, with reference to FIG. 4, the connecting channel 226 may be formed in one nozzle plate 124. The connecting channel 226 is configured to receive the second fluid from the inlet channel 224 and allow the second fluid to flow generally in a second direction D2, substantially perpendicular to the first direction D1. In one embodiment, the first direction D1 may extend substantially in a horizontal or length direction, and the second direction D2 may extend substantially in a vertical or height direction.

A width W of the connecting channel 226 may vary along a height H of the connecting channel 226. For example, in one embodiment, the connecting channel 226 may have first width at an inlet section 230 where the second fluid is received from the inlet channel 224, and a second width at an intermediate section 232, the second width being less than the first width. A base section 234 of the connecting channel 226 may have a third width greater than both the first width and the second width. In one embodiment, the base section 234 of the connecting channel 226 may be substantially square or rectangular in shape. The inlet section 230 and intermediate section 232 may have curved sidewalls to provide a smooth, or continuous (i.e., non-stepwise) transition between different widths.

The one or more second openings 228 may be formed in one or more of the nozzle plates. In one embodiment, as shown in FIG. 4, the one or more second openings 228 are formed in a single nozzle plate 122. In one embodiment, the openings of the one or more second openings 228 may be formed as a plurality of opening pairs 236. The one or more second openings 228 are configured to receive the second fluid from the connecting channel 226, and split the second fluid conduit 132 into a plurality of flow paths. The one or more second openings 228 are configured to allow the second fluid to flow substantially in a third direction D3. In one embodiment, the third direction D3 may extend in a substantially horizontal or length direction, and extend substantially perpendicular to the second direction D2 and opposite to the first direction D1. The one or more second openings 228 may be formed in a generally lower portion of one or more nozzle plates.

One plate of the laminated nozzle assembly 110 includes one or more orifice assemblies 238 for discharging the first and second fluids. In one embodiment, the one or more orifice assemblies 238 may be formed in a centrally positioned plate 120, also referred to herein as an orifice plate. Each orifice assembly 238 may include one or more first orifices 134 and one or more second orifices 136. It is understood, however, that the first and second orifices 134, 136 may be positioned on another, non-centrally positioned plate of the nozzle assemble 110. The first orifice 134 is in fluid communication with, and is configured to receive the first fluid from the first fluid conduit 128. The second orifice 136 is in fluid communication with, and is configured to receive the second fluid from the second fluid conduit 132. In one embodiment, the first and second orifices 134, 136 lie in a plane that is parallel to the abutting surfaces of the plates of the nozzle assembly 110; that is, as best seen in FIGS. 3, 4 and 5*b*, the first and second orifices 134, 136 are coplanar. In one embodiment, the first and second orifices 134, 136 may lie along a common center line, and may also be formed entirely or partially in a single plate, such as the orifice plate 120.

In one embodiment, each orifice assembly 238 may include two second orifices 136 associated with a single first orifice 134. For example, the first orifice 134 may be positioned between a pair of second orifices 136. Accordingly, two second orifices (one second orifice 136 from adjacent pairs of second orifices 136) may be positioned between adjacent first orifices 134 formed in the same plate 120, in a configuration where more than one orifice assemblies 238 are provided. In such an embodiment the three orifices (two second orifices 136 and one first orifice 134) are coplanar. However, the present disclosure is not limited to this configuration. For example, a second orifice 136 corresponding to each first orifice 134 may be provided, such that first and second orifices 134, 136 are alternately positioned along the nozzle assembly 110 when more than one orifice assembly 238 is provided.

Each first orifice 134 is configured to receive the first fluid from a corresponding first opening 214 of the one or more first openings 214. Similarly, each second orifice 136 is configured to receive the second fluid from a corresponding second opening 228 of the one or more second openings 228. In one embodiment, each second opening pair 236 may be positioned to deliver the second fluid to a corresponding pair of second orifices 136, where the pair of second orifices 136 is associated with a single first orifice 134.

Accordingly, in the embodiments described herein, the reservoir 212 and one or more first openings 214 of the first fluid conduit 128 are formed in nozzle plates disposed at a first side of the orifice plate 120. A portion of the inlet channel 224, the connecting channel 226 and the one or more second openings 228 are formed in nozzle plates disposed at a second side of the orifice plate 120, opposite to the first side. Thus, the orifice plate 120 may receive the first fluid from one side, i.e., the first side, and the second fluid from another side, i.e., the second side. For example, the one or more first orifices 134 may receive the first fluid, flowing in the first direction D1 from the first side, while the one or more second orifices 136 may receive the second fluid, flowing in the third direction D3, from the second side.

In use, according to one embodiment, the first fluid, for example a hot melt adhesive, is received in the first fluid inlet 126. The first fluid may then be received in the first fluid conduit 128. The first fluid flows from the first fluid conduit 128 to the one or more first orifices 134 and is then discharged from the nozzle assembly 110. The second fluid, for example air, may be received in the second fluid inlet 130 and flow to the second fluid conduit 132. In one embodiment, a flow path in the second conduit 132 may extend in the first direction D1 through the plates 116, 118, 120, 122, 124, in a second direction D2 substantially perpendicular to the first direction, and in the third direction D3 generally opposite to the first direction (that is, flowing back toward plate 120). The one or more second orifices 136 may receive the second fluid from the second fluid conduit 132 to discharge the second fluid from the nozzle assembly 110.

More specifically, in one embodiment, the first fluid may flow in the first direction D1 in the first fluid inlet 126 to the reservoir 212. In the reservoir 212, the first fluid may flow in the second direction D2, for example, in a height direction H, and also in a width W direction. The first fluid then continues to flow in the first direction D1 to the one or more first openings 214. In one embodiment, the one or more first openings 214 include a plurality of first openings 214. The first openings 214 may define multiple, substantially parallel flow paths for the first fluid, and direct the fluid to corresponding first orifices 134. Thus, in one embodiment, the number of first openings 214 corresponds to the number first orifices 134, and each first opening 214 is in fluid communication with a respective first orifice 134.

Further, in one embodiment, the second fluid may flow in the first direction D1 in the second fluid inlet 130 to the inlet channel 224. The second fluid may continue to flow in the first direction D1 through the inlet channel 224 to the connecting channel 226. In the connecting channel 226, the second fluid may flow generally in the second direction D2, for example, the height direction H, and also in the width direction W. The second fluid may then continue to flow in the third direction D3 to the one or more second openings 228. In one embodiment the one or more second openings 228 includes a plurality of second openings 228. The plurality of second openings 228 may define multiple, substantially parallel flow paths for the second fluid and direct the second fluid to corresponding second orifices 136. Thus, in one embodiment, the number of second openings 228 corresponds to the number of second orifices 136, and each second opening 228 is in fluid communication with a respective second orifice 136.

The first fluid may flow generally in the second direction D2 in the first orifice 134 to be discharged from the first orifice 134. Similarly, the second fluid may flow generally in the second direction D2 in the second orifice 136 to be discharged from the second orifice 136.

In the embodiments above, the number of plates may vary. It is understood that the number of plates in the nozzle assembly 110 may be reduced by including first and/or second fluid plenums in either of the end plates 112, 114. In one example, the number of plates between end plates 112, 114 may be reduced to three or four.

Figure 5A:
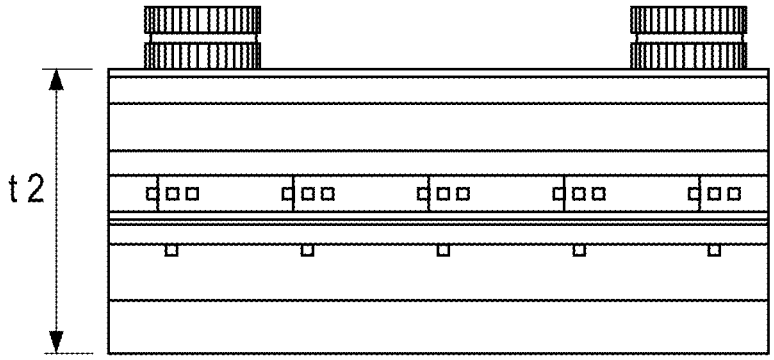
Fig. 5a Prior Art
FIG. 5*a* is a bottom view of the conventional laminated nozzle assembly of FIG. 1.
Figure 5B:
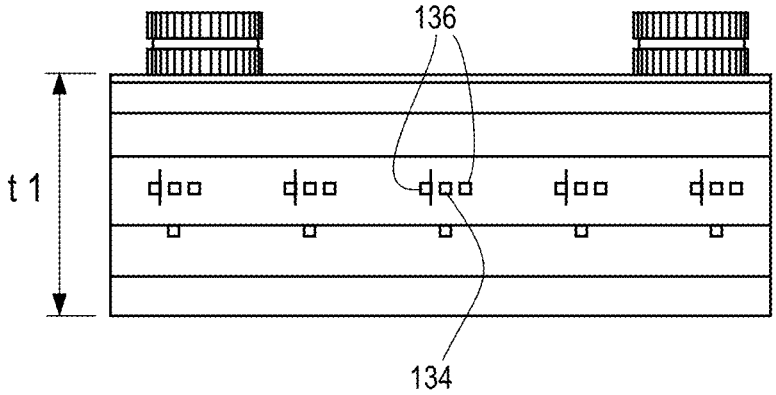
FIG. 5*b* is a bottom view of the laminated nozzle assembly of FIG. 3, according to an embodiment described herein.

FIG. 5*a* is a bottom view of the conventional laminated nozzle assembly 10 and FIG. 5*b* is a bottom view of the laminated nozzle assembly 110 according to the embodiments described herein. Referring to FIGS. 5*a* and 5*b*, it may be seen that although a thickness of the individual nozzle plates may be increased in the laminated nozzle assembly 110, an overall thickness 't1' of the nozzle assembly 110 may be reduced compared to the thickness 't2' of the conventional nozzle assembly 10 (FIG. 5*a*) by reducing the number of plates. For example, the conventional nozzle assembly 10 may have a thickness 't2' of about 11.1 mm, while the nozzle assembly 110 described herein may have a thickness of, for example, 9.5 mm.

In one embodiment, the laminated nozzle assembly 110 described herein may operate at temperatures up to about 218 C, and at an air pressure of about 0.3 to 2.1 bar. It is understood, however, that the present description is not limited to these ranges, and that the laminated nozzle assembly 110 described herein may be designed and manufactured to accommodate varying operating temperatures and air pressures. In one embodiment, the individual laminated nozzle plates may have a thickness ranging from 0.005 mm to 1.00 mm, for example, and more specifically, may have a range of thickness between about 0.125 to 0.50 mm. It is understood that the thickness of the nozzle plates may vary, and in other embodiments, may be less than 0.005 mm or greater than 1.00 mm.

In one embodiment, the orifice plate 120 may have a thickness greater than the thicknesses of the other respective nozzle plates. Forming the orifice plate 120 with an increased thickness relative to the other nozzle plates increases the strength of the orifice plate 120. Thus, deflection or deformation of the orifice plate 120 as a result of forces form the first and second fluids applied thereon may be reduced, minimized or substantially eliminated in comparison to the conventional nozzle assembly 10.

Figure 9A:
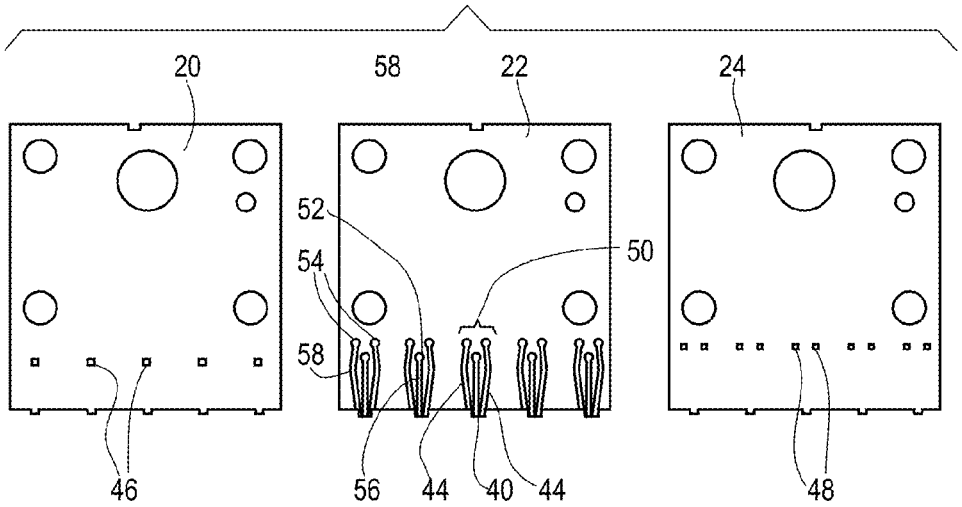
FIGS. 9*a* and 9*b* are front views of selected nozzle plates in the conventional laminated nozzle assembly of FIG. 1 (FIG. 9*a*) and a laminated nozzle assembly of FIG. 3 according to an embodiment described herein (FIG. 9*b*).
Figure 9B:
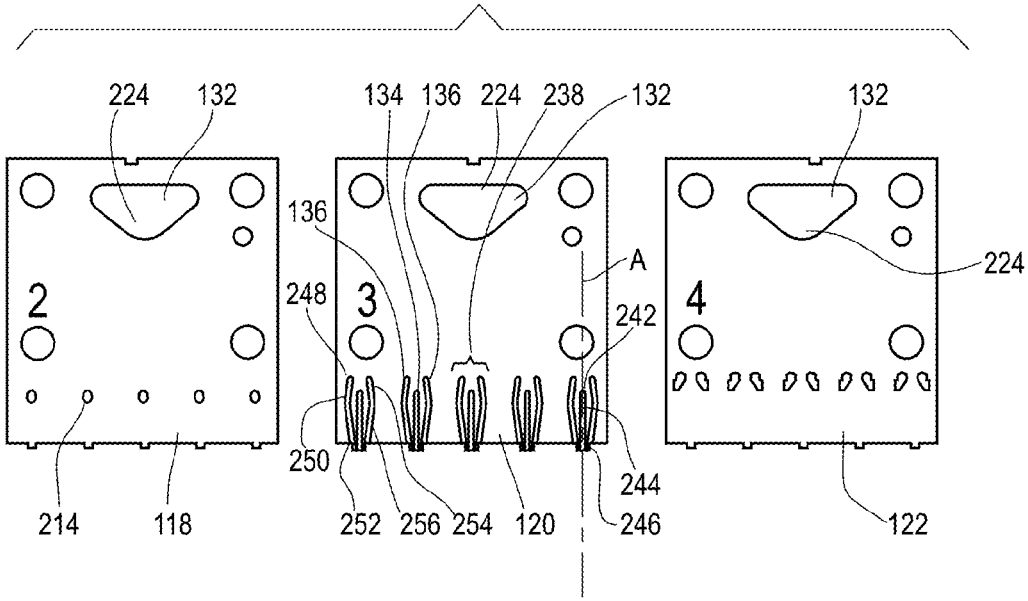

FIG. 9*b* is a plan view showing nozzle plates according to the embodiments described herein. In particular, FIG. 9*b* shows plates 118, 120 and 122 of the laminated nozzle assembly 110 described herein. Referring to FIG. 9*b*, in one embodiment, plate 118 includes the first openings 214 and a portion of the inlet channel 224 of the second fluid conduit 132. The orifice plate 120 includes a portion of the inlet channel 224 of the second fluid conduit 132 and orifice assemblies 238 having the first and second orifices 134, 136. Plate 122 includes a portion of the inlet channel 224 of the second fluid conduit 132 and the second openings 228.

Referring still to FIG. 9*b*, according to an embodiment described herein, the first openings 214 may be formed as slots, or other similar oblong or elongated, non-circular shapes. Accordingly, an area of each first opening 214 may be increased compared to the first apertures 46 of the conventional assembly 10 shown in FIG. 9*a*. For example, in one embodiment, each first opening 214 may have an area of approximately 0.00123 $in^2$. Thus, an area in which the first fluid may flow to the first orifice 134 in the first opening 214 may be approximately four times greater than a corresponding area of the first apertures 46 in the known assembly. However, the present disclosure is not limited to these dimensions, and improved flow characteristics through the first openings 214 may be realized by an increase in size of, for example, 50% when compared to the first apertures 46 of the conventional nozzle assembly 10.

With further reference to FIG. 9*b*, the second openings 228 may also be formed as slots, or other similar oblong or elongated, non-circular shapes. Accordingly, an area of each second opening 228 may be increased compared to the second apertures 48 of the conventional assembly 10 of FIG. 9*a*. For example, in one embodiment, each second opening 228 may have an area of approximately 0.00151 $in^2$. Thus, in an embodiment where the second openings 228 are formed as opening pairs 236, each pair may have a combined area of approximately 0.00302 $in^2$. Thus, an area in which the second fluid may flow to the second orifice 136 in the second opening 228 may be approximately five times greater than a corresponding area of the second apertures 48 in the known assembly. The second openings 228 may also be tilted or offset at an angle relative to a vertical axis of the nozzle plates and/or the first orifice 134. However, the present disclosure is not limited to these dimensions, and improved flow characteristics through the second openings 228 may be realized by an increase in size of, for example, 50% when compared to the second apertures 48 of the conventional nozzle assembly 10.

Referring to FIGS. 4 and 9B, the nozzle assembly 110, according to one embodiment described herein, may include five orifice assemblies 238. However, it is understood that the number of orifice assemblies 238 may vary, and the present disclosure is not limited to the examples shown in the figures. Accordingly, each orifice assembly 238 may discharge the first fluid, such as a hot melt adhesive, from the first orifice 134, and discharge the second fluid, such as air, from the second orifice(s) 136 to act on the first fluid, causing the first fluid to oscillate or vacillate. Thus, each orifice assembly 238 may discharge a strand of the first fluid for application onto an underlying substrate in a non-linear pattern.

Referring again to FIG. 9*b*, in one embodiment, as discussed above, each orifice assembly 238 may include a single first orifice 134 and a pair of second orifices 136. The first orifice 134 may extend between the second orifices of the pair of the second orifices 136, such that the second orifices are disposed in mirrored relationship on opposite sides of, or about, the first orifice 134.

In one embodiment, the first orifice 134 extends substantially in the height direction H along an axis, for example, a vertical axis A. The first orifice 134 includes an inlet section 242, an intermediate section 244 and an outlet opening 246. The intermediate section 244 extends between the inlet section 242 and the outlet opening 246. The inlet section 242 may be formed to substantially correspond in size and shape to the first opening 214. Thus, the inlet section 242 may be substantially oblong, elongated, and/or non-circular to correspond to the slot-like shape of the first opening 214. As such, a transition between the inlet section 242 and the intermediate section 244 may be substantially smooth, or less angular, than in a corresponding transition in a known assembly. Accordingly, the flow of the first fluid from the inlet section 242 to the intermediate section 244 may be less restricted, and collection of the first fluid and/or drops in velocity may be reduced.

Additionally, in one embodiment, each second orifice 136 may include an inlet section 248, and intermediate section 250 and an outlet opening 252. The intermediate section 250 extends between the inlet section 248 and the outlet opening 252. In one embodiment, moving in a direction from the inlet section 248 to the outlet opening 252, each second orifice 136 may include a diverging section 254 which diverges away from the axis A of the first orifice 134, and a converging section 256 which converges toward the axis A of the first orifice 134. The inlet section 248 may be formed in at least a portion of the diverging section 254. In one embodiment, the second openings 228 are angled, or tilted, to substantially corresponding to an angle at which the diverging sections 254 are disposed relative to the axis A. With this configuration, a transition area from an inlet section 248 to an intermediate section 250 where a width of the second orifice 136 narrows may be completely or substantially eliminated, and fluid collection or reduction in velocity may be substantially avoided.

In the embodiments above, fluid velocity through the nozzle assembly may be increased compared to the known nozzle assembly 10, due at least in part to fewer restrictions in the fluid conduits, larger passages in the conduits, a more direct flow path between the respective inlets and orifices, and a shorter travel distance for the fluid in the laminated nozzle assembly 10. The fluid conduits, including various openings and transitions in the flow paths, are sufficiently large so as to allow particulate matter or contaminants, including char products, of a size those having skill in the art would understand may typically be found in hot melt applications systems, to pass through substantially without plugging of the conduits. Thus, a filter plate or filter mechanism may be omitted from the laminated nozzle assembly 110 of the present embodiments. Omission of a filter plate or filter mechanism further improves flow characteristics (e.g., velocity) of fluid through the nozzle assembly 110 when compared to the known nozzle assembly 10. Further, due at least in part to the increased fluid velocity in the first and second fluid conduits 128, 132, start/stop performance of the nozzle assembly 110 may be improved, and more precise application patterns may be realized.

Figure 6A:
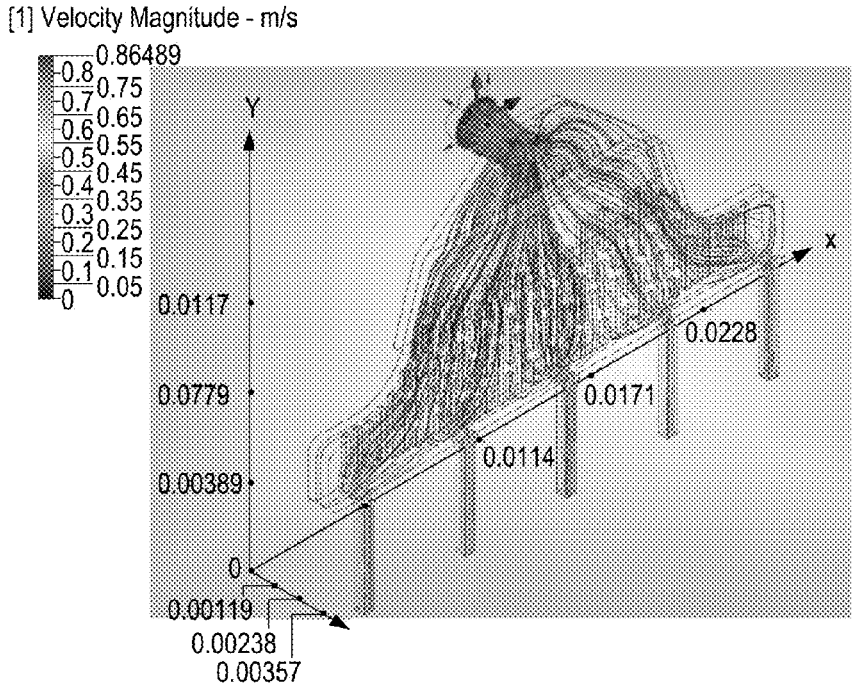
Fig. 6a Prior Art
FIGS. 6*a* and 6*b* are perspective color illustrations of a Computational Fluid Dynamic (CFD) model of fluid flow in a conventional laminated nozzle assembly (FIG. 6*a*) and a laminated nozzle assembly according to an embodiment described herein (FIG. 6*b*)
Figure 6B:
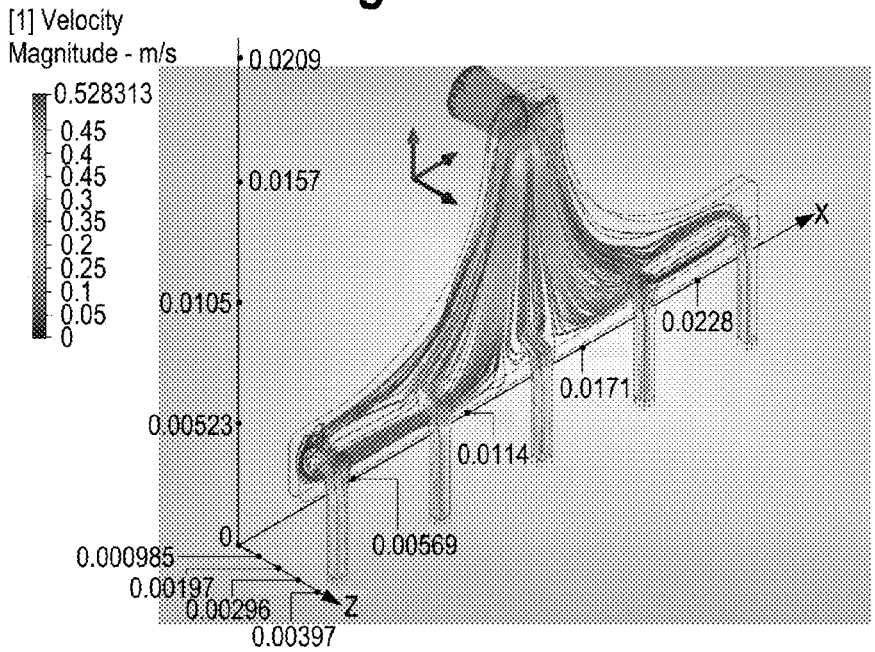

FIGS. 6*a* and 6*b* are perspective views of a Computational Fluid Dynamic (CFD) model of fluid flow in a conventional laminated nozzle 10 assembly (FIG. 6*a*) and a laminated nozzle assembly 110 according to an embodiment described herein (FIG. 6*b*). As can be seen in a comparison of FIGS. 6*a* and 6*b*, the first fluid may move at a higher velocity within the laminated nozzle assembly 110, and be discharged from the laminated nozzle assembly 110 at a higher velocity when compared to the conventional laminated nozzle shown in FIG. 6*a*.

Figure 7A:
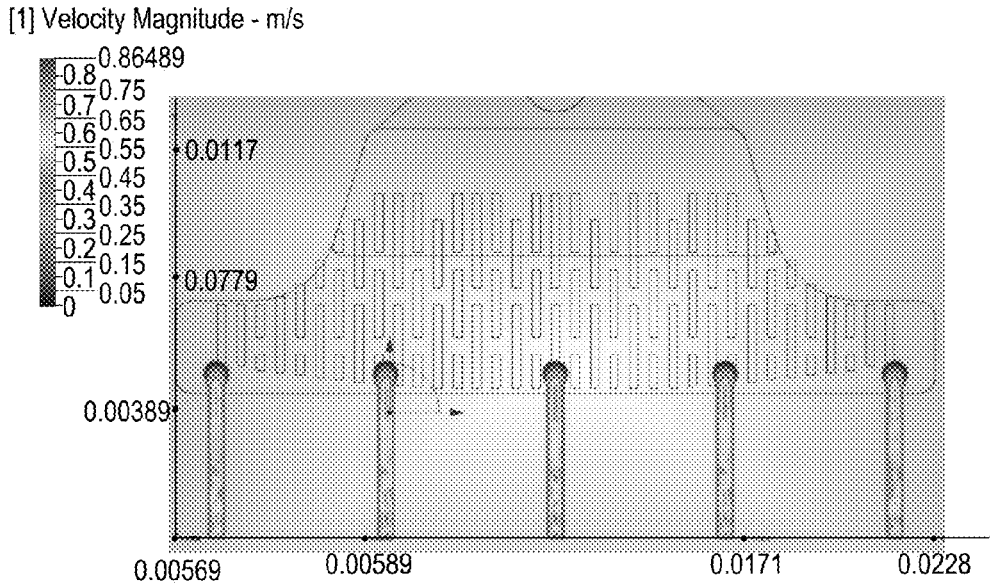
Fig. 7a Prior Art
FIGS. 7*a* and 7*b* are cross-sectional color illustrational views of a Computational Fluid Dynamic (CFD) model of fluid flow in a conventional laminated nozzle assembly (FIG. 7*a*) and a laminated nozzle assembly according to an embodiment described herein (FIG. 7*b*)
Figure 7B:
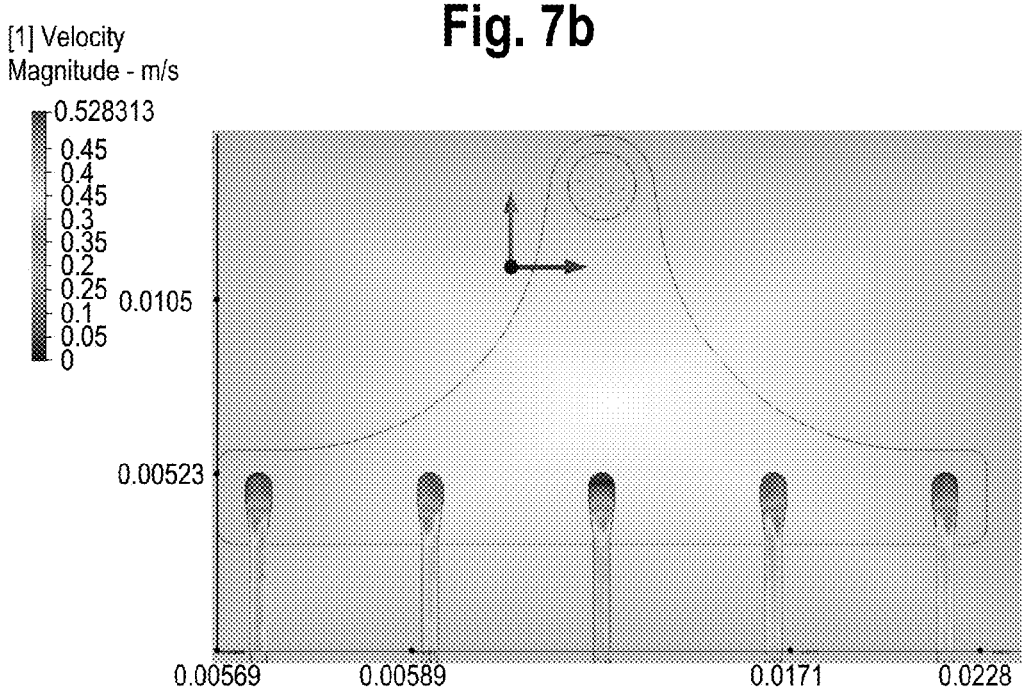

FIGS. 7*a* and 7*b* are cross-sectional views of a CFD model of fluid flow in a conventional laminated nozzle assembly 10 (FIG. 7*a*) and a laminated nozzle assembly 110 according to an embodiment described herein (FIG. 7*b*). As can be seen in a comparison of FIGS. 7*a* and 7*b*, the first fluid may move at a higher velocity within the first orifice 134 of the laminated nozzle assembly 110, when compared to the conventional laminated nozzle 10 shown in FIG. 7*a*. Further, in the laminated nozzle assembly 110 of the present embodiment, as shown in FIG. 7*b*, the first fluid flows in the first orifice 134 at a more uniform velocity, compared to the fluid in the discharge slot 40 of the conventional nozzle assembly 10. This results in a more consistent and predictable volume flow rate of the first fluid discharged from the first orifice 134, and improves deposition characteristics of the first fluid onto the substrate.

Figure 8A:
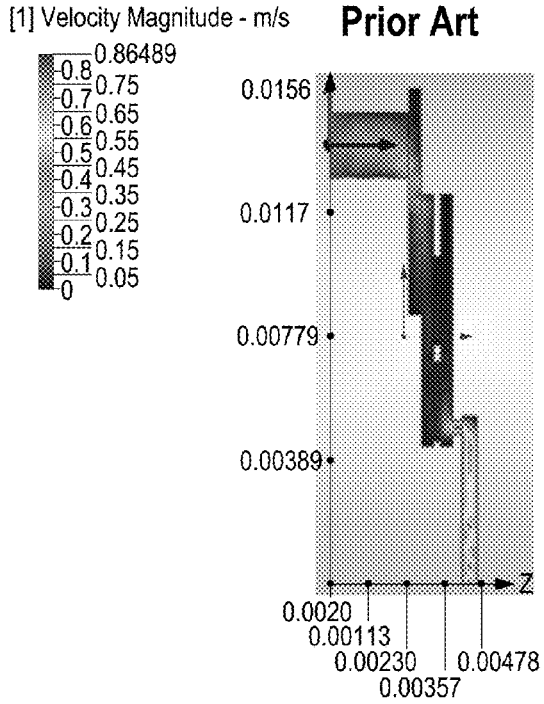
Fig. 8a Prior Art
FIGS. 8*a* and 8*b* are side cross-sectional color illustrational views of a Computational Fluid Dynamic (CFD) model of fluid flow in a conventional laminated nozzle assembly (FIG. 8*a*) and a laminated nozzle assembly according to an embodiment described herein (FIG. 8*b*)
Figure 8B:
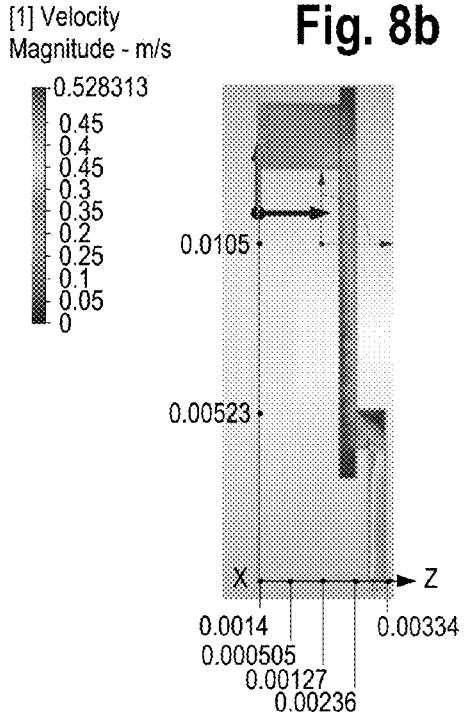

FIGS. 8*a* and 8*b* are side cross-sectional views of a CFD model of fluid flow in a conventional laminated nozzle assembly 10 (FIG. 8*a*) and a laminated nozzle assembly 10 according to an embodiment described herein (FIG. 8*b*). As can be seen in a comparison of FIGS. 8*a* and 8*b*, the first fluid may move at a higher velocity within the laminated nozzle assembly 110 and within the first orifice 134, when compared to the conventional laminated nozzle 10 shown in FIG. 8*a*. In addition, as discussed above with reference to FIG. 7*b*, the first fluid may flow in the first orifice 134 at a more uniform velocity compared to the fluid in the first discharge slot 40 of the conventional nozzle assembly 10.

In the embodiments above, an improved flow path may be provided. For example, when compared to the conventional laminated nozzle assembly 10, higher fluid velocity through nozzle 110 may be realized, especially in a fluid plenum plate (for example, the central plate 120). Orifice entry passages may also be increased in size up to, for example, 50% or more, thereby improving flow of the first and second fluid through the nozzle assembly 110. Accordingly, nozzle plugging may be reduced, thereby reducing down time of the device. The nozzle assembly 110 described herein may also be easier to clean and maintain, thereby reducing labor requirements. In addition, nozzle lifetime may be increased and a potential to improve processing of polyolefin adhesive chemistries may be realized. Further still, a more direct flow path and more even distribution may be realized. The benefits above may be realized as result of the more direct flow paths in the nozzle assembly 110 described here, resulting in fewer restrictions and/or change of directions in the respective flow paths for the first and second fluids. The laminated nozzle assembly 110 described herein may be implemented in a fluid application device for applying fluid, for example, a hot melt adhesive, on a substrate, including but not limited to a layer of material or a strand of material.

It will be appreciated by those skilled in the art that because of the improved flow path (compared to the conventional laminated nozzle assemblies), the present nozzle assembly may be more forgiving when the chemistry and manufacturing of the adhesive is as well controlled, in that contaminants that may be present in the material and charring that may occur at what are otherwise normal operating temperatures will be less prone to plug flow paths in the conduits.

It will be appreciated by those skilled in the art that the relative directional terms such as upper, lower, rearward, forward and the like are for explanatory purposes only and are not intended to limit the scope of the disclosure.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular. For example, one or more fasteners 16 may be used in the embodiments above. Similarly, the die extruder may include one more fastening bores and one or more insertion bores.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover all such modifications as fall within the scope of the claims.

What is claimed is:

1. A laminated nozzle assembly comprising:

a first end plate having a first fluid inlet and a second fluid inlet;

a second end plate;

a plurality of nozzle plates positioned and clamped between the first end plate and the second end plate;

a first fluid conduit in fluid communication with the first fluid inlet formed in one or more of the nozzle plates, the first fluid conduit having a reservoir and one or more first openings positioned in fluid communication with the reservoir;

a second fluid conduit in fluid communication with the second fluid inlet formed in one or more of the nozzle plates, the second fluid conduit having an inlet channel, a connecting channel positioned in fluid communication with the inlet channel, and one or more second openings positioned in fluid communication with the connecting channel; and an orifice assembly having a first orifice in fluid communication with a corresponding one of the first openings to receive the first fluid from the first opening, and a second orifice in fluid communication with a corresponding one of the second openings formed to receive the second fluid from the second opening, wherein the first orifice and second orifice are disposed in the same plate of the plurality of nozzle plates and are coplanar.

2. The laminated nozzle assembly of claim 1, wherein the plurality of nozzle plates includes less than eight nozzle plates.

3. The laminated nozzle assembly of claim 1, wherein the plurality of nozzle plates includes no more than five nozzle plates.

4. The laminated nozzle assembly of claim 3, wherein the nozzle assembly includes three nozzle plates.

5. The laminated nozzle assembly of claim 1, wherein at least one plate of the plurality of nozzle plates has a thickness of about 0.005 to about 0.500 mm.

6. The laminated nozzle assembly of claim 1, including one or both of first and second fluid plena and wherein the first and/or second fluid plena are in the first and/or second end plates, respectively.

7. The laminated nozzle assembly of claim 6, wherein the nozzle assembly includes three nozzle plates.

8. The laminated nozzle assembly of claim 1, including a plurality of orifice assemblies.

9. The laminated nozzle assembly of claim 8, wherein the plurality of orifice assemblies are coplanar.

10. The laminated nozzle assembly of claim 1, wherein the orifice assembly includes a single first orifice and a pair of second orifices, the first orifice disposed between the second orifices of the pair of second orifices.

11. The laminated nozzle assembly of claim 10, wherein the second orifices of the pair of second orifices are disposed in mirrored relationship on opposite sides of the first orifice.

12. The laminated nozzle assembly of claim 11, wherein each second orifice includes a diverging section extending away from the first orifice and a converging section extending toward the first orifice moving in a direction from an inlet section to an outlet opening of each of the second orifices.

13. The laminated nozzle assembly of claim 1, wherein the one or more first openings have an elongated, non-circular shape.

14. The laminated nozzle assembly of claim 13, wherein the first orifice includes an inlet section configured to receive the first fluid from a corresponding first opening of the one or more first openings, and the inlet section has an elongated, non-circular shape, corresponding in size and shape to the corresponding first opening.

15. The laminated nozzle assembly of claim 1, wherein the one or more second openings have an elongated, non-circular shape.

16. The laminated nozzle assembly of claim 15, wherein the one or more second openings includes a pair of second openings.

17. The laminated nozzle assembly of claim 16, wherein each second opening of the pair of second openings are tilted at an angle relative to a vertical axis.

18. The laminated nozzle assembly of claim 15, wherein the second orifice includes an inlet section substantially corresponding in size and shape to the second opening.

19. The laminated nozzle assembly of claim 1, wherein the plurality of nozzle plates positioned between the first and second end plates do not include a filter plate.

20. The laminated nozzle assembly of claim 1, wherein the inlet channel extends in the plurality of plates from the second fluid inlet to the connecting channel.

* * * * *